United States Patent [19]

Molyneux

[11] 3,934,800

[45] Jan. 27, 1976

[54] TRACK RAIL ANCHORAGES

[75] Inventor: George Molyneux, Gloucester, England

[73] Assignee: Molyneux Rail Clips Limited, Gloucester, England

[22] Filed: Apr. 15, 1974

[21] Appl. No.: 461,123

[30] Foreign Application Priority Data

Apr. 17, 1973 United Kingdom ..... 18348/73

[52] U.S. Cl. ..... 238/341; 238/282; 238/310; 238/340; 238/349

[51] Int. Cl.[2] ..... E01B 9/30

[58] Field of Search ..... 238/349, 338, 339, 341, 238/288, 351, 304, 315, 282, 340

[56] References Cited

UNITED STATES PATENTS

| | | | |
|---|---|---|---|
| 1,056,834 | 3/1913 | Ritter | 238/341 |
| 1,279,726 | 9/1918 | Liebmann | 238/282 |
| 2,258,964 | 10/1941 | Wood et al. | 238/349 |
| 3,028,099 | 4/1962 | Molyneux | 238/341 |
| 3,724,754 | 4/1973 | Molyneux et al. | 238/349 |
| 3,784,098 | 1/1974 | Serafin et al. | 238/349 |

*Primary Examiner*—Robert A. Song
*Assistant Examiner*—Richard A. Bertsch
*Attorney, Agent, or Firm*—Young & Thompson

[57] ABSTRACT

A track rail anchorage comprises a base member having projection flanges projecting from the two ends thereof, either of which may be placed so as to locate over the flange of a rail to be located in position. The base is provided with asymmetrical mounting means so that when one projection flange in location with the rail flange is exchanged for the other, the position of the new projection flange relative to the rail will be displaced towards or away from the rail, thus catering for possible displacements of parts of the rail due to distortion defects. Additional adjustment of the anchorage position may be achieved by employing a variable, eccentric, mounting in the base to receive a mounting bolt fixed in the ground.

1 Claim, 2 Drawing Figures

TRACK RAIL ANCHORAGES

This invention is concerned with anchorages for resiliently securing track rails on a rail bed. Such anchorages commonly incorporate some form of projection member locating over the track rail, and a mounting bolt or like member secured into the ground for holding the anchorage firmly in position.

Normally the anchorage bolts or the like for the anchorages are set in parallel lines in the requisite positions either side of the rail to be anchored. However, the rail may not be entirely straight, or the rail position may alter with time. The latter can occur due to unequal settlement of columns supporting the rails or because the ground on which the rails are mounted shifts gradually over a period of time. It is therefore one object of this invention to provide an anchorage whose position relative to an anchorage bolt or the like may readily be adjusted.

Accordingly, this invention provides a track rail anchorage comprising a base member from both ends of which extend a rail locating projection member, either of which may be placed adjacent to and in location with a rail, the base member being provided with asymmetrical mounting means for mounting the base member on an anchorage bolt, or the like.

The preferred embodiment of the invention is formed with a passageway in the base member, for receiving the bolt or the like, which passageway is positioned off-centre between the two ends. Thus, in the two alternate positions, the end of the base member facing the track rail will be closer to the anchorage bolt in one position than in the other. For additional variation of the positioning of the base member relative to the bolt or the like, to accommodate variations in the position of the track rail it is preferred that the passageway for the base member receives a rotary cam having an eccentrically located bore through which the mounting bolt or the like will pass.

In the preferred embodiment, the base member is mounted on feet at the four corners thereof. Although the locating projection members could be in the form of spring clips extending from the base member, a simple arrangement wherein the projection members are extending flanges, will be suitable for most purposes. Ideally, though not necessarily, the surface of the flange to locate over the track rail is provided with a resilient body to bear on the track rail.

The invention also extends to the combination of one or more anchorages as hereinbefore defined, in association with and anchoring a track rail, the rail being mounted on a resilient bed.

Figure 1:
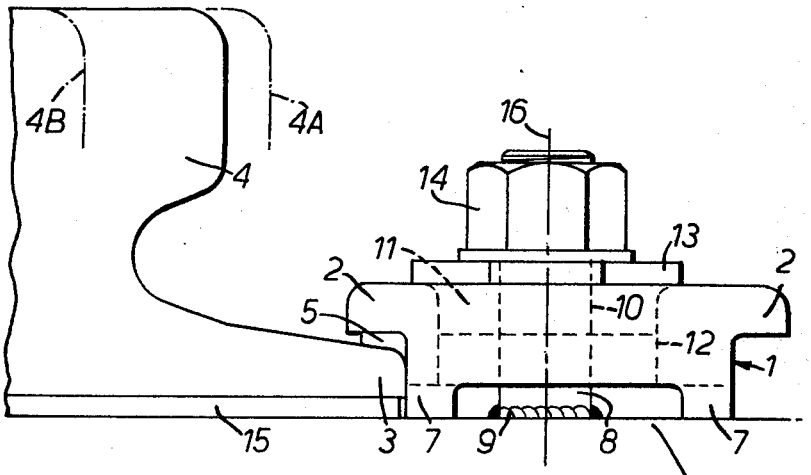
Figure 2:
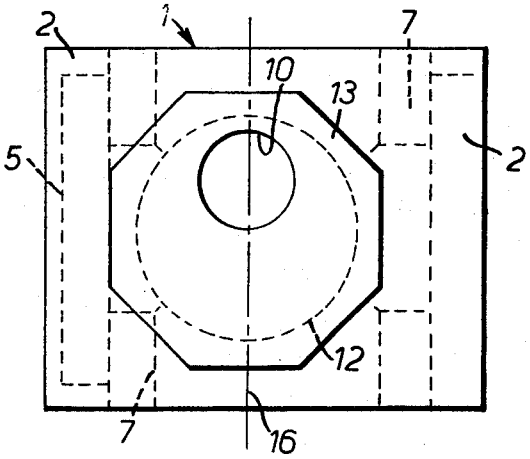

The invention may be performed in various ways, and one preferred embodiment thereof will now be described, by way of example only, with reference to the accompanying drawing, in which:

FIG. 1 is a side view of an anchorage of this invention securing a track rail; and FIG. 2 is a plan view of the anchorage of FIG. 1.

The anchorage shown in the drawings comprises a base member 1 having projecting flanges 2 extending from either end thereof, one of which is seen to locate over the flanges 3 of a track rail 4. Between the projecting flange 2 and the rail flange 3, there is provided a strip of resilient material 5 which may be attached to the undersurface of the flange 2, or merely positioned there, where it will be held by virtue of the relative angles between the undersurface of the flange 2 and the upper surface of the rail flange 3. The base member 1 is mounted on the ground plate 6 by means of four feet 7 whose longest edges (as seen in FIG. 2) locate against the rail flange 3 to provide a good bearing surface against the rail.

The base member 1 is located and secured on the ground plate 6 by means of a threaded bolt 8 which is welded at 9 to the ground plate 6. The bolt 8 passes through an eccentrically positioned bore 10 in a rotary cam 11 which is rotatably mounted within a passageway 12 in the base member 1.

The track rail 4 is mounted onto the ground plate 6 by a bed of resilient material 15.

From FIG. 1 in particular it will be appreciated that the axis 16 of the passageway 12 is offset from the centre of the base member 1 (i.e., the mid point between the two ends); thus if the base member is removed and replaced over the bolt 8 in the alternative position so that the other flange 2 locates over the rail flange 3, the centre of the base member 1 will have been moved by an amount equal to twice the difference (e.g., ¼ inch) between the axis of the passageway 12 and the centre of the base member 1, thus providing a certain amount of adjustment to accommodate any misalignment of the rail. Further adjustment may be achieved by rotating the rotary cam 11 (by means of the hexagonal portion 13 which may be gripped by a spanner). When the desired position is achieved, the locking nut 14 will be screwed down onto the bolt 8 to hold the base member 1 firmly against the track rail 4. In the example shown a degree of adjustment of 2 inches to accommodate movement of a rail 4 between the limits 4A and 4B indicated, may be achieved.

It will be appreciated that if the anchorages shown in the drawings are to be used in circumstances where gradual misalignment of a rail may be expected to occur in one particular direction, the fullest possible adjustment may be achieved by positioning the mounting bolt 8, at the side of the rail to which the rail is expected to shift, at a position such that the flange 2 which is furthest from the passageway 12 will locate the rail when the rotary cam has been rotated so that the flange 2 is at the furthest position from the bolt 8. The maximum subsequent adjustment will be determined by the position which will be occupied by the anchorage when the flange which is closest to the passageway 12 locates the rail and is closest to the bolt 8 upon suitable rotation of the rotary cam 11. The bolts on the other side of the rail will be mounted at the closest possible position to the rail initially.

The use of anchorages with the large degree of adjustment provided is of course also useful to accommodate rails which are not entirely straight and may be used to a certain extent with track rails of different widths without the need for providing separate sized anchorages for each rail width. The base could also be formed with flanges 2 of differing heights, so that two different heights of track rail flange could be accommodated.

I claim:

1. In combination with a track rail having a bottom rail flange that rests on a base supporting surface, an upstanding bolt rigidly secured to said supporting surface, a base anchorage member having two end surfaces to bear against and locate the edge of said rail flange, there being a circular passage in said base member, the axis of said passage being substantially closer to one said end surface than to the other said end surface, a rotary cam mounted for rotation in said circular passage, said bolt being eccentrically and relatively rotatably received in said cam, a flange projecting from each said end of said base member, and feet on said base member supporting said base member on said supporting surface, said end flanges being of a height above said supporting surface such that said feet rest on said supporting surface when either of said flanges on said base member overlies said bottom rail flange and a said end surface contacts said bottom rail flange.

* * * * *